United States Patent [19]

Nohl

[11] Patent Number: 5,044,428

[45] Date of Patent: Sep. 3, 1991

[54] AIR POWERED HEATER/MIXER

[75] Inventor: Andre Nohl, San Jose, Calif.

[73] Assignee: Spectra-Physics, Inc., San Jose, Calif.

[21] Appl. No.: 358,772

[22] Filed: May 30, 1989

[51] Int. Cl.[5] ..... B01F 13/02; B01F 15/06

[52] U.S. Cl. ..... 165/85; 165/109.1; 366/101; 366/146; 366/147; 366/220

[58] Field of Search ..... 366/101, 107, 144, 146, 366/147, 219, 220; 99/348, 483; 165/85, 109.1, 80.1

[56] References Cited

U.S. PATENT DOCUMENTS

| | | | |
|---|---|---|---|
| 478,737 | 7/1892 | Cushman | 165/85 |
| 2,288,137 | 6/1942 | Jones | 165/85 |
| 2,895,718 | 7/1959 | Prather | 165/85 |

*Primary Examiner*—Albert W. Davis, Jr.

*Attorney, Agent, or Firm*—Killworth, Gottman, Hagan & Schaeff

[57] ABSTRACT

A heater/mixer device is disclosed for use with laboratory vials, test tubes, or similar containers containing liquids. The heater/mixer includes a chamber formed in a block of material such as aluminum, with an electric heating element in contact with the block. The vial fits loosely in the chamber. Compressed air passes into the chamber through an inlet in the block, so that the vial is revolved by a circular air flow in a vortex fashion. This revolving motion creates a vortex in the liquid inside the vial, and so mixes the liquid. The air circulation also improves heat transfer from the block to the vial.

16 Claims, 4 Drawing Sheets

AIR POWERED HEATER/MIXER

BACKGROUND OF THE INVENTION

1. Field of the Invention

This invention relates to a device and method for heating and mixing of liquids, as is done in chemical reactions or processes or similar circumstances. The invention especially relates to heating and mixing of small quantities of liquids in small laboratory containers such as vials.

2. Description of the Prior Art

Many methods of mixing and heating liquids are known. The known methods of mixing include using a manual or magnetic stirring rod, electric mixers, and shaking manually or by machine. Many methods of heating liquids confined to a container are also known, including use of ovens, electric heating elements applied to a heat conductive container, putting the container in a larger container of hot liquid or steam, and provision of radiant heat. These prior art methods of heating and of mixing all have significant deficiencies when used in the typical chemical process application, especially for mixing and heating small quantities of liquid. For instance, many of the various heating methods are incompatible with simultaneous mixing, especially when the liquid to be mixed is confined to a typical glass vial (i.e., test tube). This is a serious deficiency, since it is often necessary to heat and mix simultaneously, for instance when dissolving a precipitate, or in order to make a process more efficient. Some of the mixing methods such as shaking require fairly elaborate and expensive equipment.

Related to shaking devices are the well-known vortex mixers. These devices hold the bottom of a vial (or test tube) and mechanically revolve the bottom of the vial to create a vortex in the liquid inside the vial. These devices are somewhat complex, and difficult to automate since the mixer must mechanically grip the vial.

Thus many of the known heating or mixing methods do not readily lend themselves to automation, i.e., handling by robotic equipment.

Some of the known mixing methods have the further deficiency of requiring access to the inside of the container, in order to insert a stirring rod or stirring bar. These methods present a handling problem with sealed containers, and may also introduce contamination when the containers are opened.

SUMMARY OF THE INVENTION

In accordance with the present invention, a heater/-mixer device is provided that uses compressed air (or other fluid moving in a stream) to create a vortex (i.e., whirlpool effect) inside a cylindrical chamber and to improve heat transfer to a vial. A vial (i.e., a small typically cylindrical container) containing the liquid to be mixed is placed inside the chamber. The compressed air or other fluid enters the chamber tangentially relative to the internal surface of the chamber and creates a strong vortex in the chamber. The air flow causes the vial to revolve in the chamber, since the chamber has a diameter larger than that of the vial. The device may simultaneously heat the vial by a heating element provided in contact with the chamber.

The heater/mixer has the advantage of being very simple, rugged, and inexpensive. It is reliable, having no mechanical moving parts. The air flow carries heat provided from the heating element efficiently from the chamber to the vial, thus improving heat transfer. The device is safe for use with volatile solvents in the case of an open vial, since vapors are blown away from the vial by the airflow, and also no motor is present which might create sparks. The device is usable with a variety of vial materials, shapes and dimensions. The heater/-mixer is also compatible with automated processing, since it is easy for a robot to place and remove the vial in the chamber which typically is open at the top. Also, the device works well with a sealed vial, since no access is needed to the inside of the vial for mixing.

BRIEF DESCRIPTION OF THE DRAWINGS

Similar reference numbers in various figures denote similar or identical structures.

DETAILED DESCRIPTION OF THE INVENTION

Figure 1A:
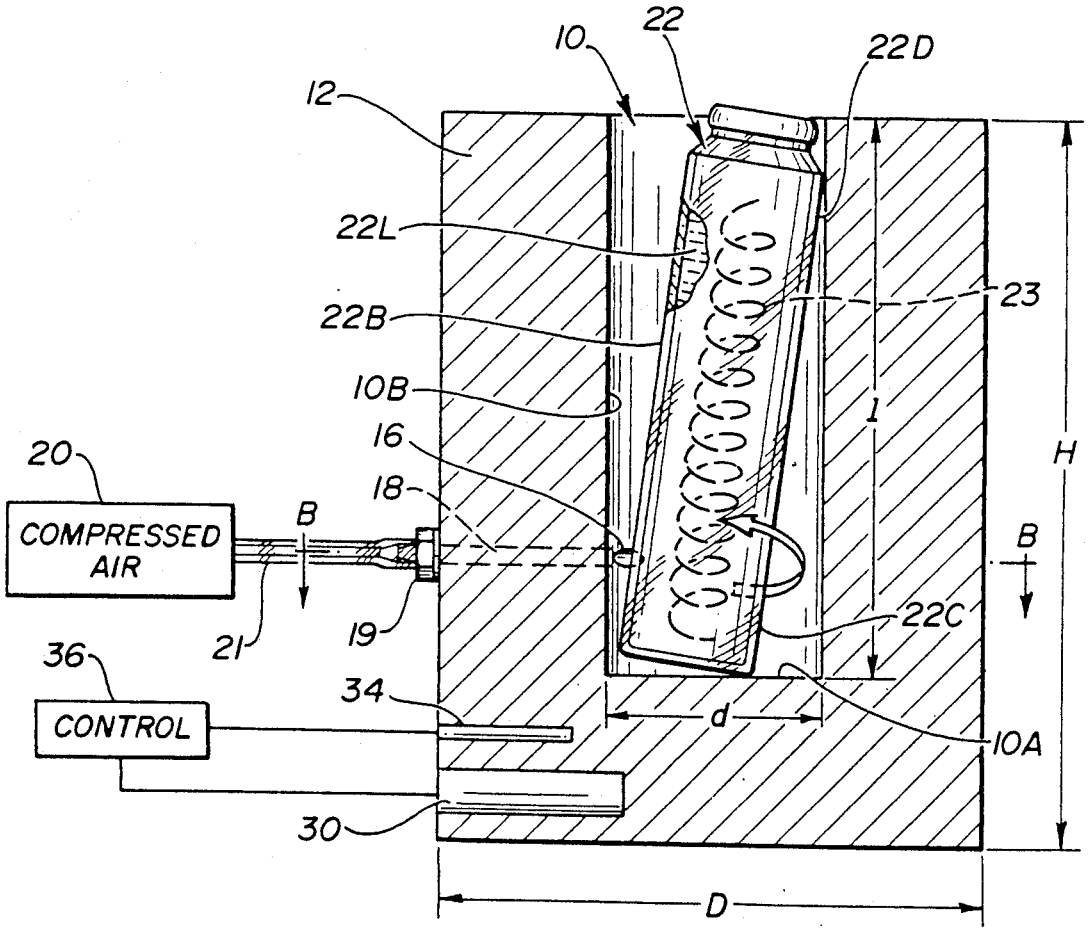
FIG. 1A shows a view of one embodiment of the present invention.

In accordance with the invention (see FIG. 1A), a chamber 10 is formed (such as by conventional machining) in a block 12 of preferably heat conductive material such as aluminum. The overall dimensions of block 12 are preferably about 8.4 cm high (dimension H) and about 6.3 cm in diameter (dimension D). The size of chamber 10 depends on the vial dimensions. For two embodiments of the invention, two different vials have been used: a 25 ml capacity vial and a 1.8 ml capacity vial. The 25 ml vial is 63 mm in length and 20 mm in diameter. The 1.8 ml vial is 32 mm in length and 12 mm in diameter. The chamber 10 is preferably cylindrical. For the 25 ml vial, the dimensions of chamber 10 are 65 mm long (dimension 1) and 25 mm diameter (dimension d). For the 1.8 ml vial, the preferred dimensions of chamber 10 are 35 mm long (dimension 1) and 13 mm diameter (dimension d). These dimensions are a matter of convenience, and are not critical to the invention. An inlet 16 machined or otherwise formed in block 12 is provided to the chamber 10. Inlet 16 is about 0.6 mm in diameter. Inlet 16 is located about 6 mm from the bottom 10A of chamber 10. Inlet 16 communicates via passage 18 (which is also about 0.6 mm in diameter) formed in block 12 to a source 20 of a fluid-stream such as compressed air. A conventional laboratory plastic barbed fitting 19 is screwed into appropriate threads provided in block 12 at the outer end of passage 18. A conventional tube 21 connects barbed fitting 19 to fluid stream source 20. This fluid stream preferably is compressed air, such as is typically available from air compressors via pipes in chemical laboratories. Other flowing gases or liquids may also be used to provide the fluid stream. The compressed air is at a pressure of about 15 to 70 psi. The flow rate depends on the size of the device. For a 1.8 ml vial, the flow rate is about 2 liters/-min. For larger vials such as a 25 mil vial, the flow rate is about 10 liters/min.

While the chamber 10 must be somewhat larger than the vial 22 in diameter, the dimensions are not critical to the invention, and a given sized chamber is suitable for use with a range of sizes of containers such as vial 22. A chamber up to twice the diameter of the vial works well. It is preferred not to have a chamber diameter much larger than this relative to the vial diameter, to facilitate retrieval of the vial from the chamber by a robot arm.

Figure 1B:
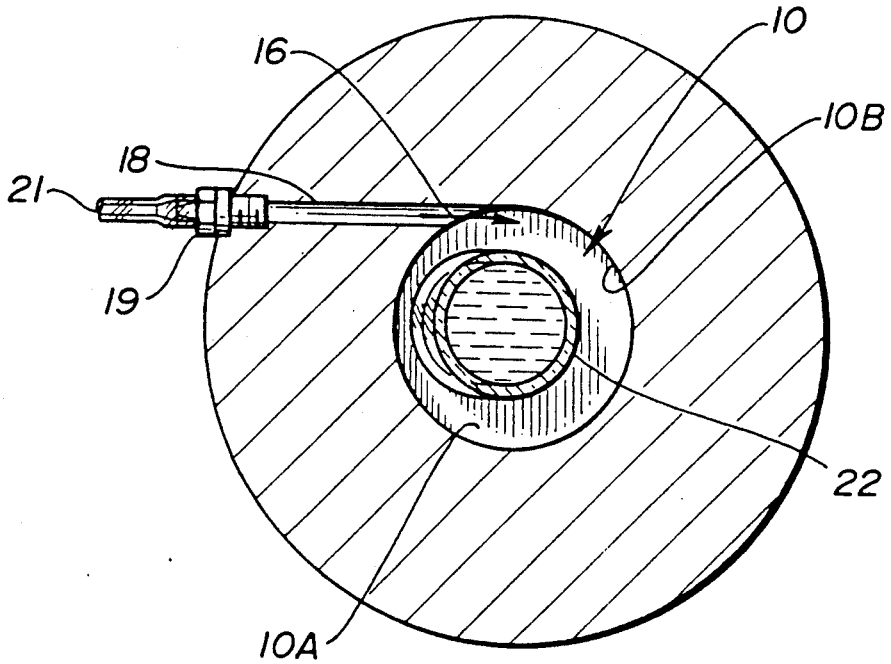
FIG. 1B is a top view of FIG. 1A.

A top view of FIG. 1A along line B—B is shown in FIG. 1B. Inlet 16 is preferably located at inner surface 10B of chamber 10 so that the compressed air (or other fluid) emerging through passage 18 from inlet 16 is moving in a direction as shown by the arrow, which is tangential to the internal surface 10B of chamber 10 and hence tangential to the surface of vial 22.

A conventional electrically powered heating element 30 (see FIG. 1A) is preferably provided inserted into a suitably machined or otherwise formed cavity 31 in the base of block 12, to provide heating. Alternatively, block 10 can rest on a heating element. Heating element 30 is an optional element of the invention; if it is omitted, the device still functions as a mixer.

In one embodiment, a temperature sensor 34 (i.e., a thermocouple) is provided inserted in block 12. This temperature sensor is connected via conventional control device 36 to heating element 30 so as to control the heating of block 12 to a desired temperature.

The heater/mixer is used as follows with reference to FIG. 1A. The sealed (or open) vial 22 containing a liquid 22L to be mixed is placed in the chamber 10, by a conventional robot arm as in an autosampling system, or alternatively by other means such as by hand. Heating element 30 is preferably activated so as to warm block 12 to the desired temperature before placing vial 22 in chamber 10. Compressed air source 20 is activated and causes the compressed air to emerge from inlet 16 and strike the surface 22B of vial 22. Alternatively, the heating element 30 and/or the compressed air source 20 are turned on before vial 22 is placed in chamber 10. Since the compressed air is moving in a direction tangential to chamber inner surface 10B, the vial 22 is caught in a vortex (i.e., whirlpool) created by the compressed air, thus revolving vial 22 in the vortex. As shown in FIG. 1A, inlet 16 is in the preferred embodiment located near the bottom 10A of chamber 10. Thus the compressed air creates a vortex near the bottom 10A of chamber 10 which revolves the lower portion 22C of vial 22 in a circle at about 100 to 400 RPM, while the upper portion 22D of vial 22 remains relatively stationary. That is, preferably vial 22 does not spin on its own axis. As shown in FIG. 1A, vial 22 when it is revolving is typically tilted slightly relative to the vertical by the compressed air vortex, and by the fact that the vial 22 is smaller in diameter than is the chamber 10. This tilt, determined by the relative size of vial 22 relative to chamber 10, is preferably 0° to 20° from the vertical. The revolution of vial 22 in the vortex provides efficient mixing of the liquid contents 22L of vial 22 by creating a corresponding vortex 23 in the liquid 22L. This vortex in liquid 22L provides a superior mixing compared to spinning vial 22 on its own axis.

The compressed air flow in chamber 10 improves the transfer of heat from heated block 12, and so heat transfer is more efficient than by means of convection alone.

Figure 2:
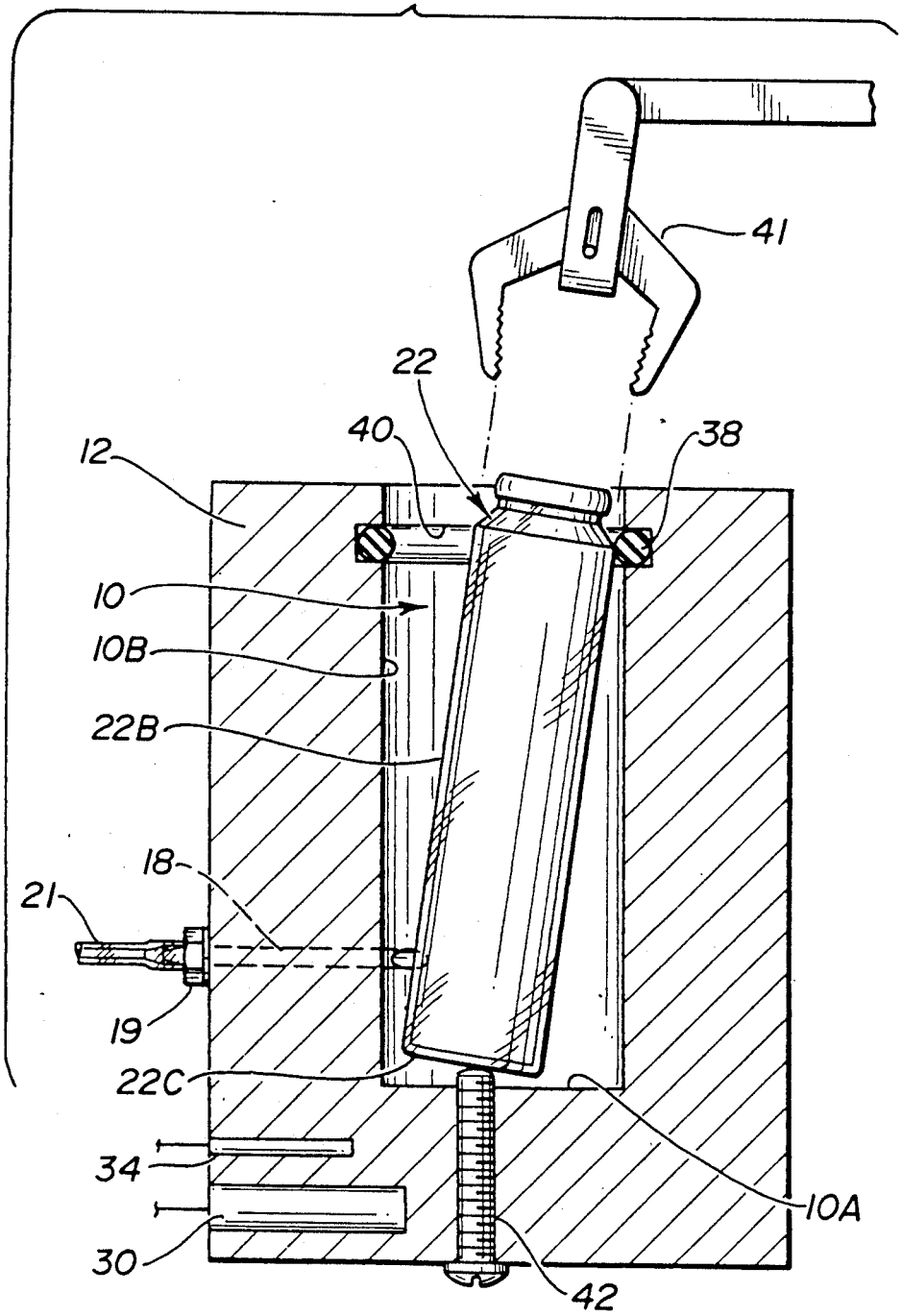
FIG. 2 shows a second embodiment of the present invention.

In one embodiment of the invention, a cushion is provided on an inner surface of the chamber so as to further reduce spinning of the vial. As shown in FIG. 2, this cushion in one embodiment is a conventional rubber or soft plastic 0-ring 38 which is located in a suitable groove 40 machined or otherwise formed in an upper portion of the inner surface 10B of chamber 10. 0-ring 38 beneficially reduces noise during the mixing process by cushioning the clinking of vial 22 against inner surface 10B as vial 22 revolves. The 0-ring 38 also desirably increases the friction between vial 22 and the inner chamber surface 10B. This increased friction prevents vial 22 from spinning around its axis, without affecting the vortex effect. Spinning of the vial is undesirable because if the vial has a typical paper label or bar code label on its outer surface 22B, spinning could damage the label as the outer surface 22B of vial 22 repeatedly contacts the inner surface 10B of chamber 10.

In one embodiment as shown in FIG. 2, a teflon or nylon screw 42 (or a similar structure) is also provided in a suitably threaded hole machined into the bottom 10A of chamber 10. The tip of teflon screw 42 extends into chamber 10. Teflon screw 42 is an anti-friction bearing to reduce friction between the bottom 22C vial 22 and the bottom 10A of chamber 10, thus enhancing the revolving motion of vial 22. Also shown in FIG. 2 is a robot arm 41, for placing vial 22 in chamber 10 and removing vial 22 from chamber 10. The other structures shown in FIG. 2 are similar to those shown in FIG. 1A.

In other embodiments of the invention, instead of compressed air, flowing streams of other gases or liquids are used to revolve the vial in the chamber. In addition to vials, any convenient container may be revolved by the vortex in the chamber, given a chamber of suitable size. Also, the air inlet may be located near the top of the chamber so as to revolve the top of the vial. Alternatively, multiple air inlets may be provided. In another embodiment, the compressed air may be admitted into the chamber from the top, so that the air inlet is at the open top of the chamber.

Figure 3:
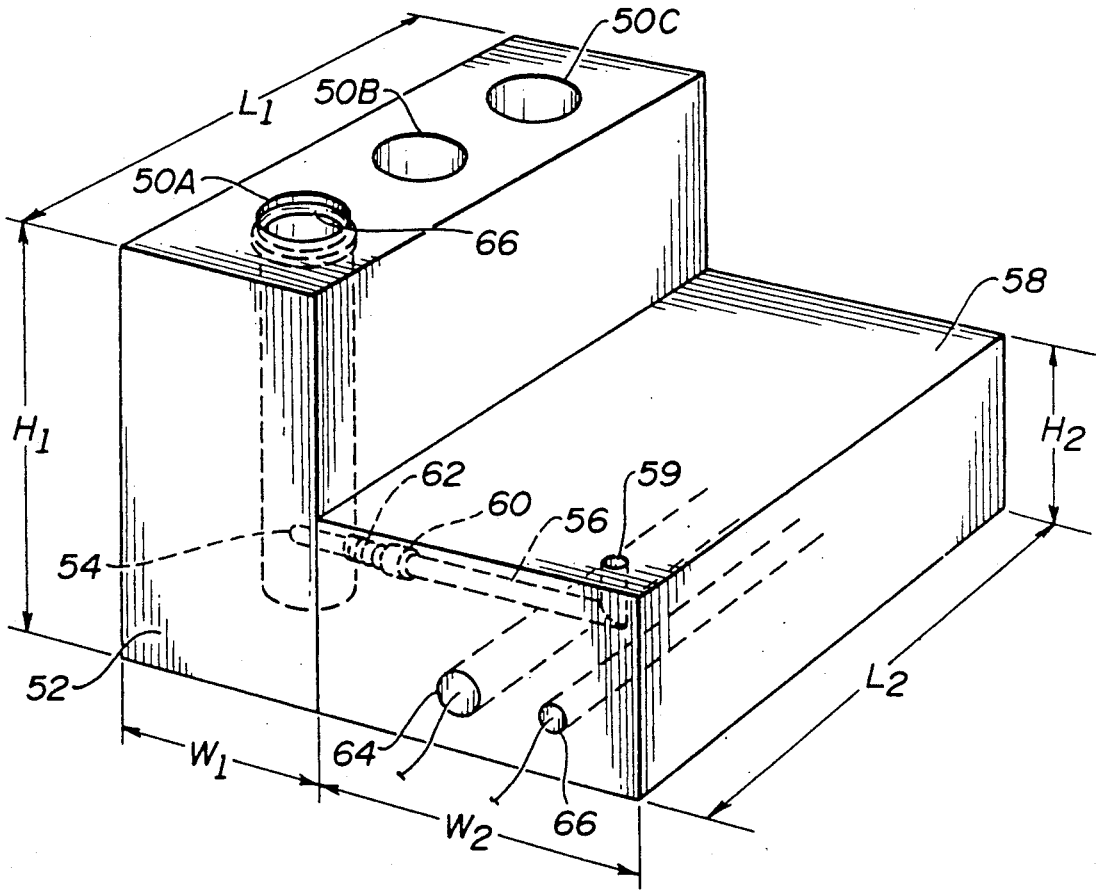
FIG. 3 shows a third embodiment of the invention.

Another embodiment of the invention is shown in FIG. 3. This embodiment includes three chambers 50A, 50B, and 50C, each of which holds one vial or test tube. (The vials are not shown for simplicity.) This embodiment is preferably formed from two machined aluminum blocks 52, 58. The three chambers 50A, 50B, and 50C are each formed in block 52, and each chamber is about 1.2 cm. in diameter and about 3.5 cm. in length (only chamber 50A is shown fully). This size chamber will accommodate a standard 1.8 ml. vial. Block 52 is about 7 cm. long (dimension $L_1$), about 3 cm. wide (dimension $W_1$), and about 6 cm. high (dimension $H_1$). Each chamber 50A, 50B, and 50C has an air inlet. Only the air inlet 54 for chamber 50A is shown. Each air inlet is located so as to admit air to its respective chamber tangentially to the inner wall of the chamber. Each air inlet is about 0.6 mm. in diameter, and connects to a corresponding passage 56 in block 58. Only passage 56 for inlet 54 is shown for simplicity. Passage 56 terminates in block 58 at air supply inlet 59, where a barbed fitting (not shown) is provided to connect to a compressed air supply tube. Passage 56 is also about 0.6 mm in diameter. Inlet 54 is about 6 mm up from the bottom of chamber 50A.

A conventional plastic barbed fitting 60 is threaded into threads cut into block 58 at the end of passage 56. Also provided in block 52 is a second conventional plastic barbed fitting 62 threaded into a suitable hole, so as to ensure that no compressed air leaks out between block 52 and block 58 by connecting fitting 62 to fitting 60.

Also provided in a suitably sized hole in block 58 is a conventional heating element 64. Adjacent to heating element 64 is a temperature sensor 66.

Block 52 is connected to block 58 by suitable screws (not shown) through block 52 and block 58. Block 58 is about 3 cm high (dimension $H_2$), about 7 cm long (dimension $L_2$) and about 5 cm wide (dimension $W_2$). Also provided (but not shown) are mounting holes passing through both block 52 and block 58 so that the heater/-mixer can be mounted to another piece of equipment or to a support by means of bolts or screws through the mounting holes.

O-rings are provided near the top of each chamber 50A, 50B, 50C. Only the 0-ring 66 near the top of chamber 50A is shown for simplicity. The O-rings, as described above, increase friction between the vial and the chamber surface.

While the above dimensions in this embodiment as shown in FIG. 3 are suitable for use of the smaller (1.8 ml) vials, it is apparent that this embodiment can include large chambers for larger vials or containers.

The above description of the invention is not limiting, and further embodiments of the invention will be apparent in light of the above disclosure.

I claim:

1. A mixer for mixing contents of a container comprising:

a chamber for freely holding the container;

a heat conductive path to the chamber;

means for providing heat to the heat conductive path;

an inlet in the chamber for admitting a flow of fluid to the chamber; and means for providing a flow of fluid to the inlet so as to revolve the container in a vortex of the flow of fluid and carry heat from the heat conductive path to the container.

2. The mixer of claim 1, wherein the inlet is located at an inner surface of the chamber so as to admit the flow of fluid in a direction tangential to a surface of the chamber.

3. The mixer of claim 1, wherein the chamber is substantially cylindrical in shape.

4. The mixer of claim 1, further comprising cushioning means formed on a surface of the chamber for cushioning the container in the chamber.

5. The mixer of claim 4, wherein the cushioning means comprises an O-ring.

6. The mixer of claim 5, further comprising a robot arm for placing the container in the chamber.

7. The mixer of claim 1, wherein the flow of fluid includes compressed air.

8. The mixer of claim 1, wherein the chamber comprises a bottom surface and further comprising a bearing formed on the bottom surface of the chamber, so as to reduce friction between the container and the bottom surface of the chamber.

9. The mixer of claim 1, wherein the chamber is formed in a body of aluminum.

10. The mixer of claim 1, further comprising a robot arm for placing the container in the chamber.

11. The mixer of claim 1, further comprising at least one additional chamber for holding a second container.

12. A method for mixing a liquid in a container comprising the steps of:

providing a chamber;

placing the container holding the liquid in the chamber; and providing a stream of heated gas to the chamber so as to revolve the container in the stream of gas inside the chamber to mix the liquid and heat the container.

13. The mixer of claim 12, further comprising the step of providing a cushion on a surface of the chamber for cushioning the container.

14. The mixer of claim 12, wherein the container does not spin on its own axis.

15. The mixer of claim 1, wherein the container does not spin on its own axis.

16. A mixer for mixing contents of a container comprising:

a chamber for holding the container;

an inlet in the chamber for admitting a flow of fluid to the chamber;

cushioning means formed on a surface of the chamber for cushioning the container in the chamber; and means for providing a flow of fluid to the inlet so as to revolve the container.

* * * * *

UNITED STATES PATENT AND TRADEMARK OFFICE

CERTIFICATE OF CORRECTION

PATENT NO. : 5,044,428

DATED : September 3, 1991

INVENTOR(S) : Andre Nohl

It is certified that error appears in the above-identified patent and that said Letters Patent is hereby corrected as shown below:

Col. 6, Line 25, "mixer" should be --method--.
Col. 6, Line 28, "mixer" should be --method--.

Signed and Sealed this

Thirteenth Day of April, 1993

*Attest:*

STEPHEN G. KUNIN

*Attesting Officer*

*Acting Commissioner of Patents and Trademarks*